US007995021B2

(12) United States Patent
Tyrrell

(10) Patent No.: US 7,995,021 B2
(45) Date of Patent: Aug. 9, 2011

(54) COMBINED GAMMA AND PHASE TABLE DATA IN MEMORY FOR LCD CSTN DISPLAYS

(75) Inventor: Julian Tyrrell, Cricklade (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 910 days.

(21) Appl. No.: 11/404,447

(22) Filed: Apr. 14, 2006

(65) Prior Publication Data

US 2007/0229423 A1 Oct. 4, 2007

(30) Foreign Application Priority Data

Apr. 4, 2006 (EP) ..... 06392005

(51) Int. Cl.
*G09G 3/36* (2006.01)

(52) U.S. Cl. ..... 345/89; 345/87; 345/88; 345/98

(58) Field of Classification Search ..... 345/87, 345/89, 88, 98

See application file for complete search history.

(56) References Cited

U.S. PATENT DOCUMENTS

| | | | | |
|---|---|---|---|---|
| 5,870,109 | A * | 2/1999 | McCormack et al. | 345/565 |
| 5,953,002 | A * | 9/1999 | Hirai et al. | 345/204 |
| 6,043,797 | A * | 3/2000 | Clifton et al. | 345/589 |
| 6,519,013 | B1 * | 2/2003 | Nagai et al. | 349/33 |
| 6,836,232 | B2 | 12/2004 | Bu | |
| 2004/0090409 | A1 * | 5/2004 | Nakata et al. | 345/89 |
| 2005/0017989 | A1 * | 1/2005 | Huang | 345/690 |
| 2005/0280624 | A1 | 12/2005 | Liu | |

* cited by examiner

*Primary Examiner* — Richard Hjerpe
*Assistant Examiner* — Saifeldin Elnafia
(74) *Attorney, Agent, or Firm* — Saile Ackerman LLC; Stephen B. Ackerman

(57) ABSTRACT

Methods and systems to optimize the adaptation of gamma curve and phase table data to a color LCD STN display anytime by storing these data in a same memory are disclosed. The gamma curve and phase table data are stored in a same read/write memory element; hence allowing the adaptation any time.

18 Claims, 3 Drawing Sheets

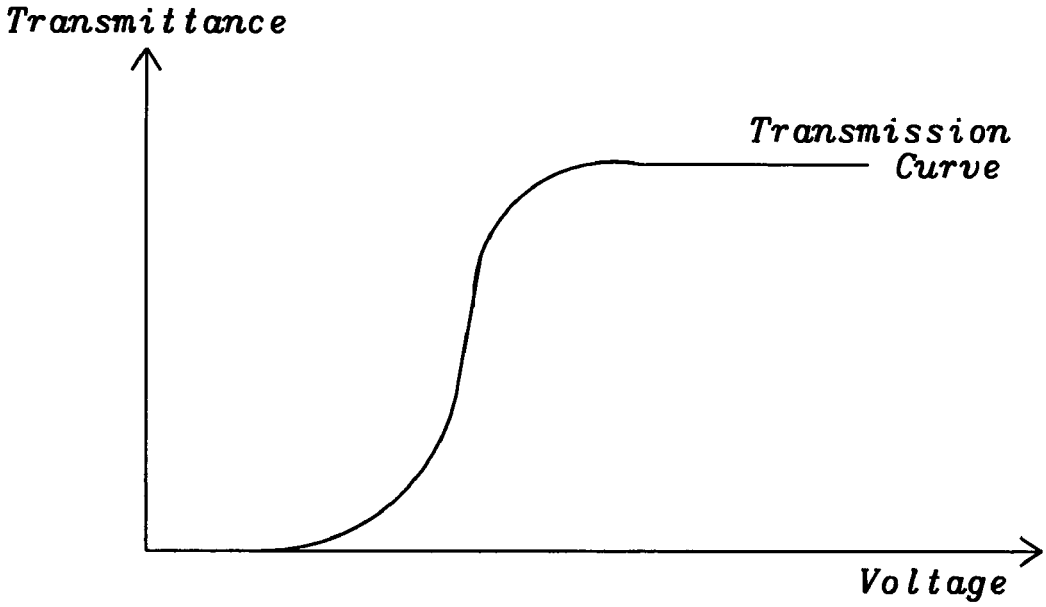
FIG. 1 – Prior Art
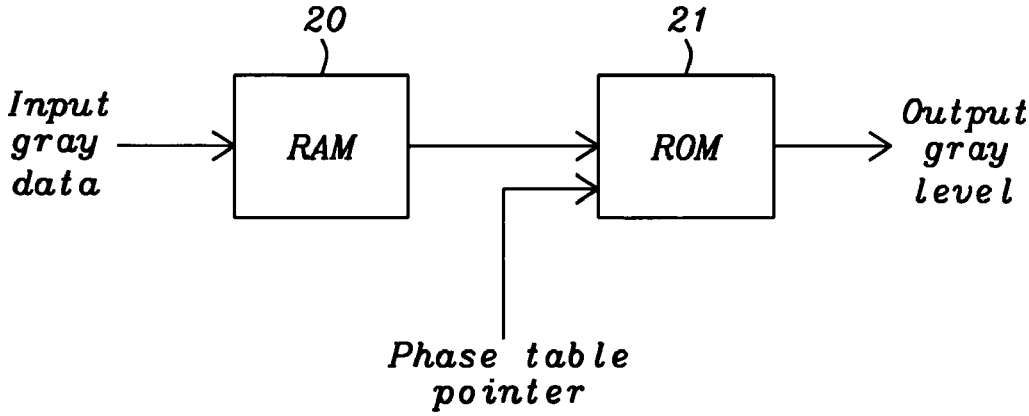
FIG. 2 – Prior Art

COMBINED GAMMA AND PHASE TABLE DATA IN MEMORY FOR LCD CSTN DISPLAYS

BACKGROUND OF THE INVENTION (1) Field of the Invention

This invention relates generally to liquid crystal displays (LCD) and relates more particularly to methods and circuits for storing gamma curve correction data and phase table data in the same memory elements of color super twist nematic (CSTN) display drivers.

(2) Description of the Prior Art

There are many types of liquid crystal displays, each with unique properties. The most common LCD that is used for everyday items like watches and calculators is called the twisted nematic (TN) display. This device consists of a nematic liquid crystal sandwiched between two plates of glass. A special surface treatment is given to the glass such that the molecules are homeotropic yet the director at the top of the sample is perpendicular to the director at the bottom. This configuration sets up a 90-degree twist into the bulk of the liquid crystal, hence the name of the display.

The difference between the ON and OFF voltages in displays with many rows and columns can be very small. For this reason, the TN device is impractical for large information displays with conventional addressing schemes. This problem was solved with the invention of the super-twisted nematic (STN) display. In this device, the director rotates through an angle of 270 degrees, compared with the 90 degrees for the TN cell.

LCD Color super twisted nematic (CSTN) is a display technology based on a passive matrix. It makes useful alternatives to active displays, at less cost. Unlike TFT, CSTN is based on a passive matrix, which is less expensive to produce. New CSTN displays offer 100 ms response times, a 140-degree viewing angle, and high-quality color rivaling TFT displays.

In order to achieve color, it is first necessary to have a display, which is black in one state and white in the other. In a white display, all wavelengths pass through and therefore, all wavelengths can be manipulated to create the desired color. To get full color, each individual pixel is divided into three sub-pixels: red, green and blue (RGB). This means that for each full color pixel, three distinct sub-pixels are employed. These sub-pixels are created by applying color filters, which only allow certain wavelengths to pass through them while absorbing the other wavelengths. Using a combination of red, blue and green sub-pixels of various gray levels, a pixel can be made to appear any number of different colors. By displaying different gray levels of RGB sub-pixels individually, different colors can be achieved. For example, if each R, G, B sub-pixel has 8 gray levels, the maximum number of display colors will be $8^3$ (512 colors).

There are two different methods to address row or COM lines of an LCD. Single-Line Addressing (SLA) or linear scan selects one COM line of the LCD after the other and Multi-Line Addressing (MLA) selects more than one COM lines at the same time. Advantages of MLA are a lower LCD driving voltage requirement which results in power saving, an improved display quality because of faster frame response times and reduced display crosstalk, due also to the lower driving voltages necessary.

The response characteristic between a numeric value expressing a color and the depth of a color input or output actually is expressed by a numeric value referred to as "gamma". FIG. 1 prior art illustrates the non-linearity of gray levels in LCDs. It shows the transmittance as function of voltage applied.

Any input/output device such as an image scanner, a display device or a printer has its own specific gamma value or gamma curve. Adjusting the gamma value or gamma curve to the specific properties of these devices performs color correction on these devices and is called gamma correction. The gamma value or gamma curve is a parameter indicating the degree of nonlinearity in the intensity of an output signal with respect to an input signal. In any display device, it will be ideal if the output intensity (the brightness of the output in the display device) changes linearly with respect to the change in the value of the input signal. However, the ideal cannot be achieved in a real device.

Usually, liquid crystal devices employ a method in which a storage device serving as a frame memory is provided in a display driver for driving a liquid crystal display panel and display data are read from the storage device and displayed. For example, at present, passive matrix liquid crystal display panels employ such gray scale display methods as the frame rate control (FRC) gray scale method, the voltage gray scale method, and the pulse width modulation (PWM) method. PWM is the subdivision of a COM period into smaller divisions to affect a linear gray scale. In the pulse width modulation method, one horizontal scanning period (1H) selected by a common driver for driving common electrodes (scanning electrodes) is divided into periods of a number that is equal to a prescribed number of gray scales and the period in which an on-waveform is applied is varied in accordance with the gray scale. The pulse width modulation method can control liquid crystal application voltages in such a manner that one horizontal scanning period (1H) is divided into periods of the number of bits constituting each unit of display data for gray scale display with weights given to the respective bits. On the other hand, there may occur a case that in applying voltages to the liquid crystal it is necessary to read out information of only a particular order bit such as MSB information or LSB information. At present, this type of driving method is used in the multi-line addressing (MLA) driving method, for example, in which a plurality of COM electrodes is selected simultaneously.

Frame rate control (FRC) is the sequence of different PWM's in each COM period to affect a linear grey scale. FRC is achieved by tuning RGB sub-pixels on and off over several frame periods. With sufficient frame refreshing time, our human eyes will average the darkness of a pixel so that the individual pixel will show the gray levels required for the color to be displayed. The fixed gray levels are formed by a combination of PWM and FRC. For example: A system that has 128 PWM and 2 FRC has a total possibility of 256 gray levels; 128 gray levels in each of two COM periods.

Phase tables can be used to indicate phases in the sequence of gradation levels of the PWM method to obtain a predetermined gradation level. With use of the table, averaged brightness in each phase table from the first frame to the fourth frame is uniform, and a flicker is difficult to see. The phase table itself is often used in the FRC method.

FIG. 2 prior art shows a block diagram illustrating how the user's input gray data are adapted to output gray levels in order to adapt the LCD driver to the display characteristics. The user's gray data are stored in a RAM 20, e.g. 64 grey levels correspondent to 6 bits gray data input (PWM values). The phase table data are stored hard coded in a ROM 21. Therefore the assignment of gray scale PWM between the individual RFC periods is fixed.

It is a challenge for the designers of passive color LCD systems to optimize the LCD driver to the display characteristics in order to eliminate unwanted display artifacts. There are known patents in the area of passive color LCD:

U.S. Pat. No. (6,836,232 to Bu) proposes a gamma correction apparatus for a liquid crystal display comprising a reference voltage generating circuit and a gamma correction circuit. The reference voltage generating circuit outputs a plurality of reference voltages according to the pixel data. The gamma correction circuit gamma-corrects the pixel data according to the reference voltages. The feature of the invention resides in that the reference voltage generating circuit outputs the corresponding reference voltages to gamma-correct the pixel data according to the positions of the pixels corresponding to the pixel data in the LCD monitor and the display colors of the pixels.

U.S. Pat. No. (6,043,797 to Clifton et al.) discloses a liquid crystal display (LCD) projection unit employing a luminance and color balance system having a lookup table storing multiple sets of gain and/or gamma corrected responses for color balance and luminance control. The lookup table values are determined by measuring an S-curve response of an LCD array for each of a set of R, G, and B input data values, converting the S-curve responses to a corresponding set of gamma responses, and scaling the gamma responses to generate red, green, and blue families of gain and gamma corrected values. Color balance is adjusted by selecting the particular R, G, and B families of gain and gamma corrected values that cause the LCD projection unit to match a predetermined ratio of maximum R, G, and B luminance values. Luminance is adjusted by selecting families of lookup table values that adjust the transmittance of the LCD while maintaining the color balance. The LCD projection unit achieves a uniform luminance and color balance that renders it suitable for use in a multiscreen display system.

U.S. Patent Application Publication (2005/0280624 to Liu) discloses a set of calibration gamma curves, and applying different driving voltages to corresponding positions of an LCD according to the set of calibration gamma curves so that at a same gray scale and at a same fundamental color, brightness is identical and no chromatic aberration occurs in all the positions of the LCD.

SUMMARY OF THE INVENTION

A principal object of the present invention is to perform anytime an optimal adaptation of gamma curve correction data and phase table data to an LCD CSTN In accordance with the objects of this invention a method to perform anytime an optimal adaptation of gamma curve correction data and phase table data to any passive color LCD technology that is responding to pulse width modulation and frame rate control (PWM/FRC) to generate gray scale images has been achieved. The method invented comprises, first, providing an input device, a processor, a color display based on primary colors, and memory elements, which can be updated anytime. The following steps of the method comprise to define number of gray levels and number of frame rate control (FRC) periods and to provide gray level values for every FRC period and for every primary color used as input into said input device. The last two steps comprise to initiate storing of said gray level values in said same memory element and to repeat steps above if quality of display is not optimal.

Also in accordance with the objects of this invention a system to optimize the adaptation of gamma curve and phase table data to any passive color LCD display technology that is responding to pulse width modulation and frame rate control (PWM/FRC) to generate gray scale images by storing these data anytime in a same memory element, wherein said colors can be based on any color space, has been achieved. The system invented comprises an input device, providing input for a processor, said processor controlling and storing said input into a volatile read/write memory and into a non volatile memory read/write memory, said volatile read/write memory, and said non-volatile memory.

BRIEF DESCRIPTION OF THE DRAWINGS

In the accompanying drawings forming a material part of this description, there is shown:

FIG. 1 prior art illustrates the non-linearity of gray levels in LCDs. It shows the transmittance as function of voltage applied FIG. 2 prior art shows a block diagram illustrating how the user's input gray data are adapted to output gray levels.

DESCRIPTION OF THE PREFERRED EMBODIMENTS

The preferred embodiments disclose methods and system to optimize the adaptation of an LCD CSTN display driver to the specific LCD characteristics. It has to be understood that this invention is applicable to any passive LCD display technology that responds to pulse width modulation and frame rate control (PWM/FRC) to generate grey scale images.

The 'user' will predominately be the LCD module manufacturer who will use this new feature to optimize the LCD display characteristics. The driver IC contains a non-volatile memory that stores the optimized gamma data, which is automatically loaded into the gamma RAMs. The end user of the module can also write data into the gamma RAMs as well (so over-writing the pre-programmed data).

Figure 3:
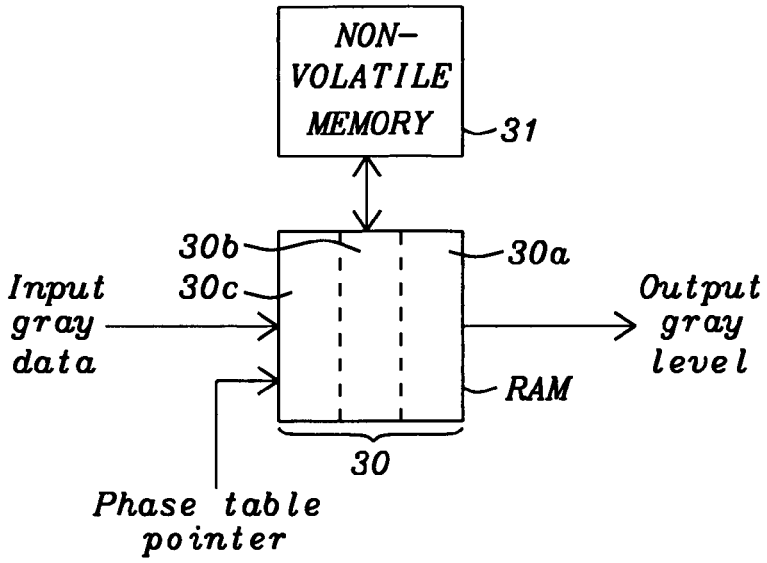
FIG. 3 shows a schematic block diagram of the major components of the system invented.

FIG. 3 shows a generic block diagram of the present invention illustrating how the user's input gray data are adapted to output gray levels. This 'user' will predominately be the LCD module manufacturer who will use this new feature to optimize the LCD display characteristics.

The LCD driver IC contains a non-volatile memory 31 that stores the optimized gamma data, which is automatically loaded into the gamma RAMs 30*a*, 30*b*, and 30*c*. The end user of the module can also write data into the gamma RAMs as well (so over-writing the pre-programmed data).

It has to be understood that the present invention is characterized by storing the gamma curve and phase table combined in the same memory element array 30, which can be a RAM, or registers. In a preferred embodiment a separate RAM for each primary color used is provided. This is indicated by sectors 30*a*, 30*b*, and 30*c* in FIG. 3 for each color. The present invention is not using a read-only memory (ROM) to store hard-coded the phase table data as shown in FIG. 1 prior art.

In prior art the assignment of grey scale pulse modulation (PWM) values between the individual frame rate control (FRC) periods is fixed because the phase table data are stored hard-coded in a ROM. The present invention has implemented this assignment in memory elements as a RAM or registers. This means that a programmable assignment of gray scale PWM for each FRC can be achieved.

Only by this programmable assignment of gray scale PWM for each FRC can an optimal adaptation of an LCD CSTN display driver to specific LCD characteristics be achieved. Using this programmable assignment unwanted display artifacts as e.g. crosstalk, flicker, or shimmer can be eliminated.

In an preferred embodiment of the invention a programmable gamma curve maps 64 gray levels for each red, green, and blue data onto 128 or 256 possible fixed output gray levels in order to linearize the optical gray response. This is required due to the non-linear nature of the LCD optical response versus the driven voltages. This mapping from the display data gray levels to the fixed output levels is programmable and stored in memory elements as a RAM of registers in the present invention.

It has to be understood that the gamma RAM concept of the present invention is applicable to any color space construction.

An LCD module manufacturer will get the data for the gamma RAM, being optimized for a specific LCD display panel, by use of additional test equipment connected to a computer to determine the desired optical response for each available grey level for each color. Test equipment as e.g. optical calorimeters, etc could be used for this purpose. A suggested 'linear' map would be initial programmed into the gamma RAMs from the computer controller. Each color of the color space used can be adjusted separately, therefore a separate RAM for each color.

The mapping of the phase table pointer across the physical panel is user selectable. This allows the phase table to be assigned in three ways: horizontal, vertical and chequerboard patterns. This gives the user complete flexibility of PWM and RFC assignment to get the best display quality.

The present invention allows the gamma curve data and phase table data to be combined in the same memory element array as e.g. registers or RAM.

For example the user's input gray data is 6-bits (64 gray levels) and the driver has 256 output gray levels, comprising 64 PWM and 4 FRC, The gamma and phase table data is stored in a 256×6-bit RAM. These user input gray data have a value for every FRC period; which requires a RAM input address range to be the number of input gray levels multiplied by the number of FRC periods; i.e. 64×4=256 bits in this case. The RAM input address is a combination of the 6-bit user data and the 2-bit phase table pointer (4 FRC in our example). The RAM output data is the selected gray level for the particular FRC period selected. In this example three 256×8 would be required for a RGB color display or in a display using another color space having three primary colors.

Figure 4:
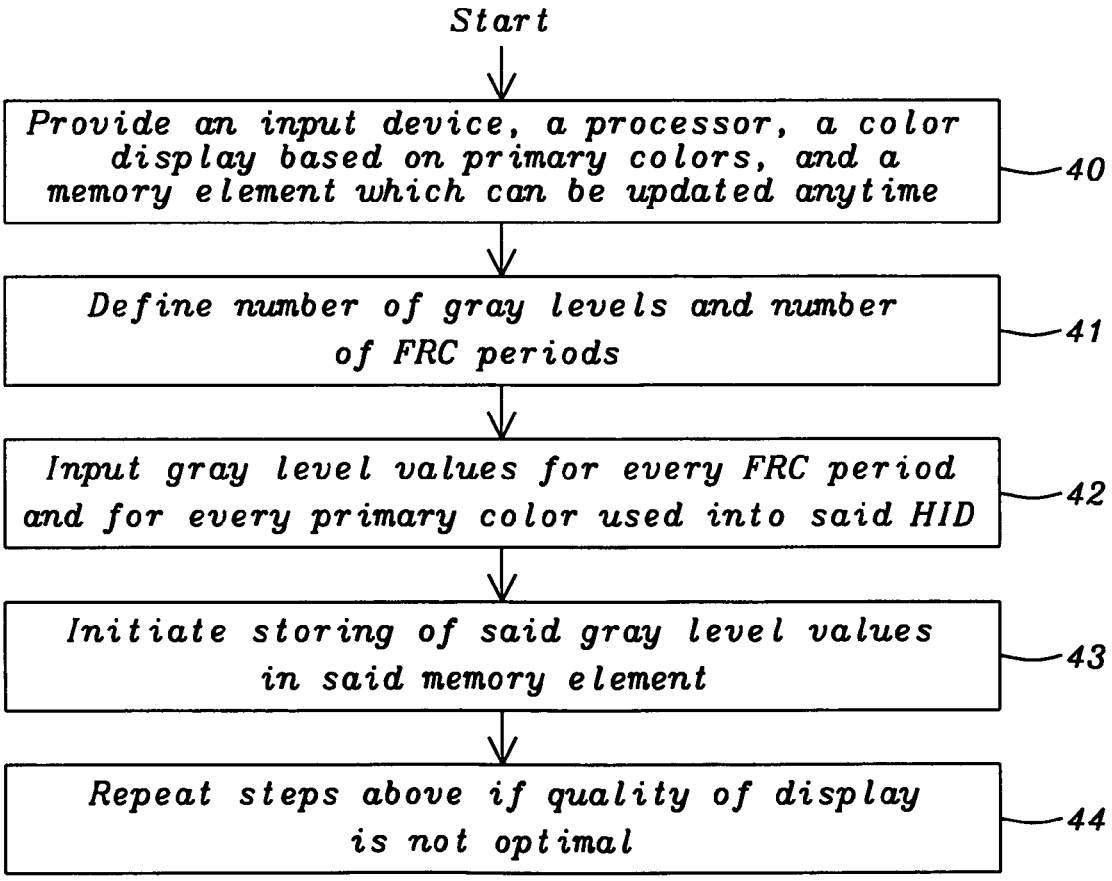
FIG. 4 shows a flowchart of a method to perform anytime an optimal adaptation of gamma curve correction data and phase table data to an LCD CSTN display.

FIG. 4 shows a flowchart of a method to perform anytime an optimal adaptation of gamma curve correction data and phase table data to an LCD CSTN display. Step 40 illustrates the provision of an input device, a processor, a color display based on primary colors, and a memory element, which can be updated anytime. Such a memory element could be registers or a RAM. In step 41 the number of gray levels and number of FRCs are defined. In step 42 the gray level values for every FRC period provided as input for said input device. This input device can be any computer, microprocessor, etc based device. The controller allows the user to input data into the display driver IC. The colors can be adjusted separately. The distribution of a specific input grey level into 4 PWM values (one for each of the FRC periods in the example above) depends not only the optical color but also the 'visual' response. This allows removal of unwanted visual artifacts like flicker, shimmer, etc. as well as any special effects across the panel. In step 43 the storing of said gray level values in said memory element is initiated and in step 44 the steps above are repeated of quality of display is not optimal.

Figure 5:
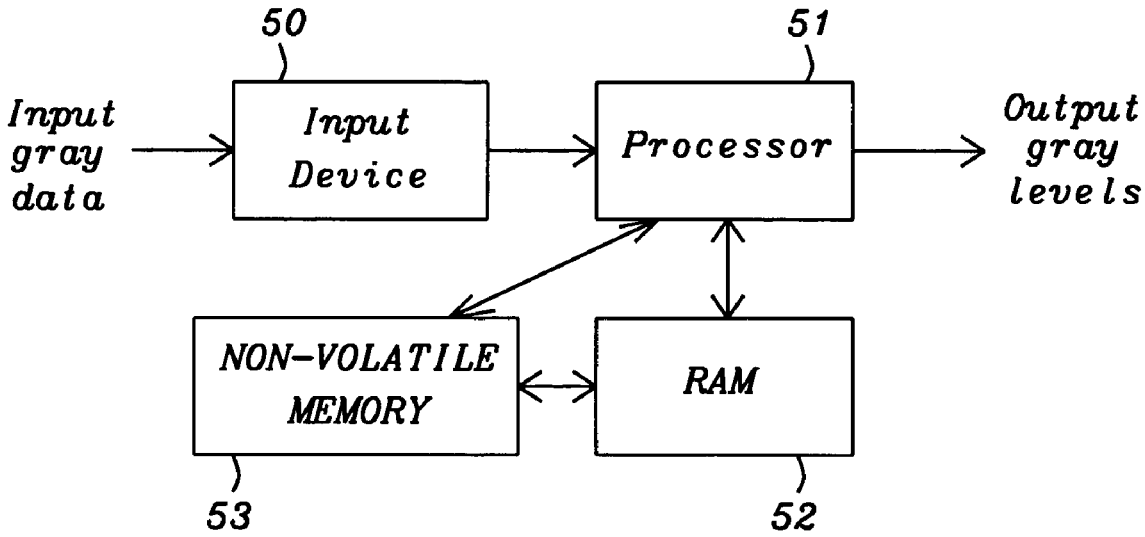
FIG. 5 illustrates a system to optimize the adaptation of gamma curve and phase table data to a color LCD STN display anytime by storing these data in a same memory element

FIG. 5 illustrates a system of the present invention allowing storing gamma curve and phase table data in the same memory elements enabling an end user to optimize the adaptation of these data to a color LCD STN display anytime. No read-only memory is used as in prior art. The system invented comprises an input device 50 for providing input to the processor 51. These data are stored by the processor in read/write memory 52 as e.g. a RAM or registers. Furthermore a non-volatile memory 53 stores finally the optimized gamma data, which is automatically loaded into the gamma RAMs 52.

The processor 51 uses a phase table pointer to output the gray levels required from the memory 52. The term 'processor' 51 here refers to the internal control logic that handles the display data though the gamma RAM's 52 to the display driver IC outputs. The display driver consists of display data RAM (the same X, Y size as the LCD panel) as well as a gamma RAM for each colors as finally the logic circuitry to generate the display driver outputs. The internal control logic (or display controller processor) handles the flow of the internal data: reading the display data RAM, conversion using the gamma RAM mapping, generating the driver outputs.

While the invention has been particularly shown and described with reference to the preferred embodiments thereof, it will be understood by those skilled in the art that various changes in form and details may be made without departing from the spirit and scope of the invention.

What is claimed is:

1. A method to perform anytime an optimal adaptation of gamma curve correction data and phase table data to any passive-matrix color LCD display that is responding to pulse width modulation and frame rate control (PWM/FRC) to generate gray scale images is comprising:

providing an input device to input gray data and phase table data into same memory elements, a processor, a passive-matrix color LCD color display based on primary colors that is responding to pulse width modulation and frame rate control (PWM/FRC) to generate gray scale images, a non-volatile memory to store optimized gamma data, and said same memory elements for storing gamma curve correction data and phase table data, indicating phases in the sequence of gradation levels, in same memory elements, which can be updated anytime;

defining number of gray levels and number of frame rate control (FRC) periods;

mapping a programmable gamma curve;

providing gray level values for every FRC period and for every primary color used as input into said input device, wherein said gray level values are to be adapted to said color display;

initiating storing of said gray level values and phase table data in said same memory elements in order to achieve a programmable assignment of gray scale PWM for each FRC;

generating an image by said color LCD using PWM with FRC control and testing quality of display; and repeating steps above if quality of display is to be improved further.

2. The method of claim 1 wherein said color LCD display is a color super twist nematic (CSTN) display.

3. The method of claim 1 wherein said memory elements are registers.

4. The method of claim 1 wherein said memory elements are combined in one RAM segment per color.

5. The method of claim 1 wherein 64 gray levels are used per FRC period.

6. The method of claim 1 wherein Red, Green, and Blue are used as primary colors.

7. The method of claim 1 wherein the optimized gamma data are stored in a non-volatile memory and loaded back to RAM if required.

8. The method of claim 1 wherein the optimized gamma data are stored in a non-volatile memory and loaded back to registers if required.

9. The method of claim 1 wherein a suggested phase table data and gamma data are initially programmed into the gamma RAMs from the computer controller.

10. The method of claim 1 wherein a mapping of the phase table pointer across the physical panel is user selectable.

11. The method of claim 10 wherein said mapping allows the phase table to be assigned in three ways: horizontal, vertical and chequerboard patterns.

12. A system to optimize anytime the adaptation of gamma curve and phase table data to any passive color LCD display technology that is responding to pulse width modulation and frame rate control (PWM/FRC) to generate gray scale images by storing these data anytime in a same memory element, wherein said colors can be based on any color space, is comprising:

an input device, providing input for a processor, wherein said input comprises phase table data and gray level values for every FRC period and for every primary color, wherein these data can be updated anytime via said input device;

a passive-matrix color LCD color display based on primary colors that is responding to pulse width modulation and frame rate control (PWM/FRC) to generate gray scale images;

said processor controlling read/write operations to a volatile memory and to a non-volatile memory;

said volatile read/write memory, in which gamma curve and phase table data combined is stored, wherein these data can be updated any time; and said non-volatile memory, in which gamma data is stored and which is automatically loaded into said volatile read/write memory.

13. The system of claim 12 wherein said volatile read/write memory is a RAM.

14. The system of claim 12 wherein said volatile read/write memory are registers.

15. The system of claim 12 wherein said LCD display is a color super twist nematic (CSTN) display.

16. The system of claim 12 wherein said color space is an R-G-B color space.

17. The system of claim 12 wherein said processor uses a phase table pointer to output the gray levels required from said volatile read/write memory.

18. The system of claim 17 wherein said processor is an internal control logic.

* * * * *